United States Patent [19]

Nagai et al.

[11] Patent Number: 4,616,368

[45] Date of Patent: Oct. 14, 1986

[54] SANITARY CLEANING APPARATUS

[75] Inventors: Kazutoshi Nagai, Nara; Hirofumi Aoyagi, Habikino, both of Japan

[73] Assignee: Matsushita Electric Industrial Co., Ltd., Osaka, Japan

[21] Appl. No.: 748,668

[22] Filed: Jun. 25, 1985

[30] Foreign Application Priority Data

Jun. 29, 1984 [JP] Japan ..... 59-135642

[51] Int. Cl.[4] ..... A47K 3/20; A47K 4/00; E03D 9/00; E03D 9/081

[52] U.S. Cl. ..... 4/420.2; 4/420.4; 4/425; 4/443; 4/DIG. 3; 4/304; 4/305

[58] Field of Search ..... 4/447, 420.2, 443–446, 4/448, 420.4, 420.5, 420.1, 303, 304, 305, DIG. 3, 623

[56] References Cited

U.S. PATENT DOCUMENTS

| | | | |
|---|---|---|---|
| 3,247,524 | 4/1966 | Umann | 4/420.2 |
| 3,314,081 | 4/1967 | Atkin et al. | 4/DIG. 3 |
| 3,908,204 | 9/1975 | Hopkins | 4/DIG. 3 |
| 4,237,560 | 12/1980 | Riegelman et al. | 4/447 |
| 4,304,016 | 12/1981 | Oguma et al. | 4/420.2 |
| 4,309,781 | 1/1982 | Lissau | 4/DIG. 3 |
| 4,389,738 | 6/1983 | Ando et al. | 4/443 |
| 4,402,095 | 9/1983 | Pepper | 4/DIG. 3 |
| 4,411,030 | 10/1983 | Kawai et al. | 4/420.2 X |

*Primary Examiner*—Henry K. Artis
*Attorney, Agent, or Firm*—Spencer & Frank

[57] ABSTRACT

A sanitary cleaning apparatus is disclosed, which comprises a cleaning water discharge device, a functional device including another cleaning water discharge device or a private parts dryer, a member for turning on and off the cleaning water discharge device, and a human body (presence or absence) detector. Only while the human body detector produces a human body detection signal, the on-off member for the cleaning water discharge device or the functional device is turned on, thereby selectively actuating a corresponding device. One of the devices thus turned on as selected above is de-energized by (a) the turning off of the on-off member of the selected device, (b) the turning on of the on-off member of the other device not selected, or (c) extinction of the human body detection signal of the human body detector.

8 Claims, 9 Drawing Figures

SANITARY CLEANING APPARATUS

The present invention relates to a sanitary cleaning apparatus for cleaning the private parts of a human body seated on a close stool with warm water.

A conventional sanitary cleaning apparatus will be explained with reference to FIG. 1 to 4.

FIG. 1 is a perspective view of a sanitary cleaning apparatus installed, in which reference numeral 2 designates a seat mounted on a close stool 1, numeral 3 a sanitary cleaning apparatus proper, and numeral 4 a cistern for storing water for washing the interior of the stool 1.

FIG. 2 shows a configuration of a conventional sanitary cleaning apparatus, in which numeral 5 designates a nozzle for discharging the cleaning water against the parts to be cleaned of the human body seated on the seat 2, numeral 6 a water filter submerged in the water in the cistern 4, numeral 7 a water heater for storing and heating the cleaning water to proper temperature, and numeral 8 a pump for absorbing water from the cistern 4 through the water filter 6 and supplying it into the water heater under pressure while at the same time discharging the cleaning water derived from the warm water in the water heater 7 to the nozzle 5 under pressure, by being driven by a motor built therein. Numeral 9 designates a warm air outlet for blowing out the warm air for drying the object parts wetted with the cleaning water, numeral 10 a wind tunnel, numeral 11 a fan for supplying air to the warm air outlet 9 through the wind tunnel 10, numeral 12 a motor for driving the fan 11, numeral 13 a heater for heating the air supplied from the fan to proper temperature, numeral 14 a control section for controlling the water heater 7, pump 8, motor 12 and heater 13, and numeral 15 an operating section for the control section 14.

FIG. 3 is a front outside view of the operating section of a conventional apparatus, in which numeral 16 designates a cleaning adjusting knob including a variable resistor for turning on and off the cleaning water discharge means and setting the amount of discharge therefrom, and numeral 17 a drying temperature knob for turning on and off the drying means and switching the drying temperature.

In this configuration, when the user seated on the seat 2 is desirous of cleaning his private parts, he switches the cleaning adjusting knob 16 from "OFF" to "ON" position. In compliance with the instruction from the control section 14, the pump 8 is started to wash the object parts with the cleaning water discharged in an amount set in the variable resistor of the cleaning adjusting knob 16. The user, desirous of drying the parts after washing, returns the cleaning adjusting knob 16 to "OFF", and switches the drying temperature knob 17 from "OFF" to "LOW" or "HIGH". Then the motor 12 and the heater 13 are actuated by an instruction from the control section 14. Hot air is thus blown toward the object parts of the human body wetted with the cleaning water from the warm air outlet 9 to dry them. The temperature of the warm air may be controlled by switching the drying temperature knob 17 between "LOW" and "HIGH". The user, desirous of finishing the drying process, returns the drying temperature knob 17 to "OFF" position.

In the cleaning operation with the conventional configuration, the drying process after operation of the cleaning adjusting knob 16 requires the cleaning adjusting knob 16 to be returned to "OFF" before operation of the drying temperature knob 17. In other words, the operation of returning the knob 16 to the position "OFF" is required each time of use of the apparatus.

It is necessary and advisable, however, to release the family members including children and aged using the apparatus from such complicated processes of operation.

In the apparatus comprising an operating switch 18 additionally provided to select the cleaning water discharge means or the drying means as shown in FIG. 4, it is also necessary to depress the off switch of the operating switch 18 each time of use of the apparatus without fail.

The user may actuate the operating section 15 by mistake while he is not seated on the seat 2 (such as when washing the apparatus) or a child may operate the operating section 15 by mischief wetting his or her clothes or the closet with the cleaning water, or the service life of the sanitary cleaning apparatus may be shortened by the continuous operation of the motor, or the like.

The object of the present invention is to obviate the above-mentioned problems of the prior art and to improve the operating efficiency and prevent the malfunction of the cleaning water discharge means for cleaning the object parts of a human body seated on the seat of the closing stool with warm water and other functional means such as for drying the object parts wetted with the cleaning water with warm air.

In order to achieve this object, according to the present invention, there is provided a sanitary cleaning apparatus comprising means for discharging the cleaning water to object parts, functional means having a function identical to or different from the cleaning water discharge means, means for turning on and off the cleaning water discharge means and the functional means respectively, and means for detecting the presence or absence of a human body, wherein one of the cleaning water discharge means and the functional means selected by the turning on of the on-off means is energized only upon the turning on of the on-off means during the detection of the presence of a human body by the human body detector means, and the one means thus selected and turned on is turned off by the turning on of the on-off means of the other means, the turning off of the on-off means of the selected means, or a human body absence signal of the human body detector means.

In the case where the user seated on the seat is desirous of cleaning or drying the object parts when the functional means provides drying means, for instance, he can clean or dry only when turning on the on-off means therefor. If the user leaves the seat during the cleaning or drying of the object parts, the human body detector means fails to detect a human body so that the cleaning or drying process, as the case may be, is automatically turned off. Specifically, the cleaning water discharge means and the drying means are kept operated only as long as the user seated in the seat is really desirous of using the apparatus, and the turning off of the cleaning water discharge means or the drying means does not require the energization of the off switch therefor or turning on the switch which is not on but only leaving the seat, thus preventing a false trip and simplifying the operation.

The above and other objects, features and advantages will be made apparent by the following detailed description taken in conjunction with the accompanying drawings, in which.

Figure 1:
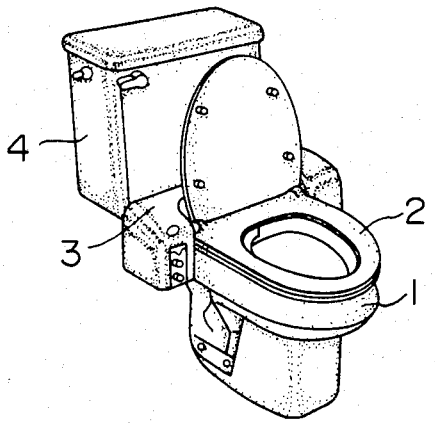
FIG. 1 is a perspective view of a conventional sanitary cleaning apparatus as installed.
Figure 2:
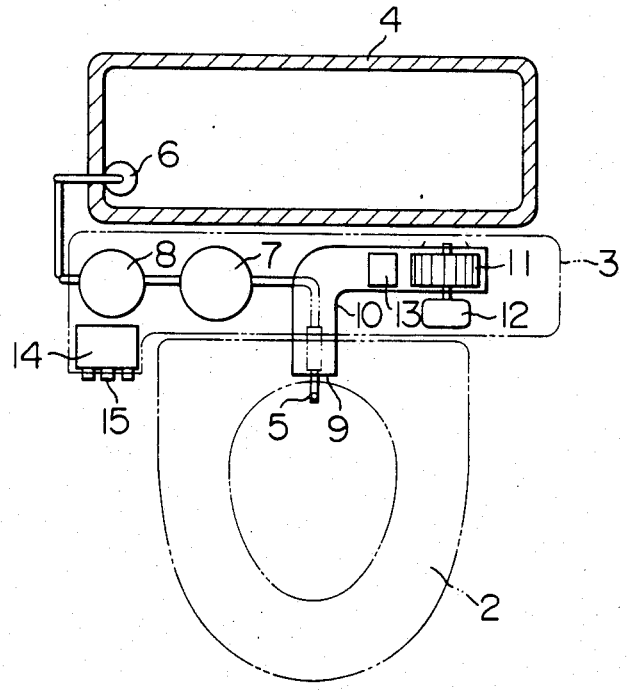
FIG. 2 is a top plan view of the same sanitary cleaning apparatus.
Figure 3:
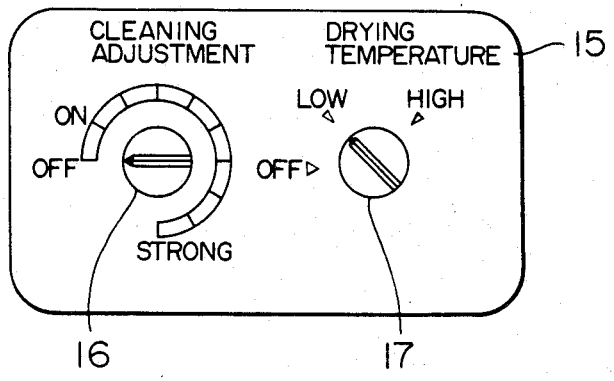
FIGS. 3 and 4 are front views of the operating section of the same sanitary cleaning apparatus.
Figure 4:
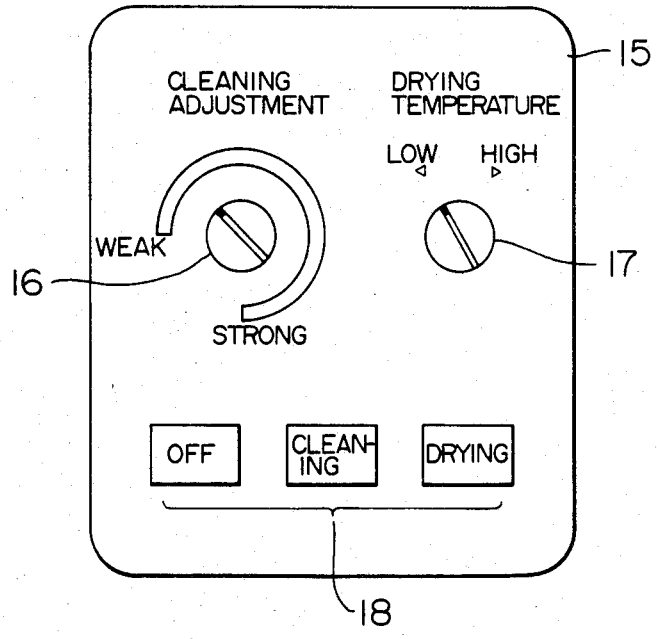
Figure 5:
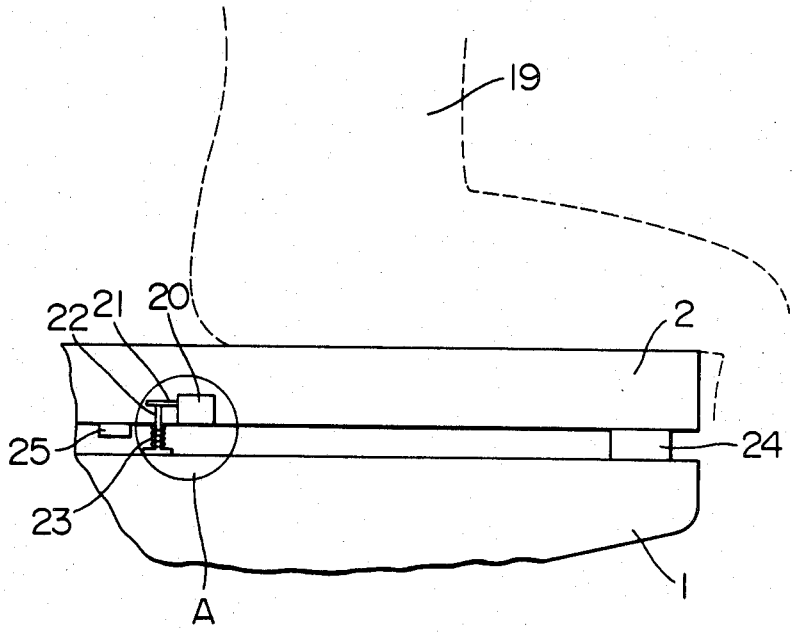
FIG. 5 is a partly cut-away sectional view of a sanitary cleaning apparatus according to an embodiment of the present invention.
Figure 6:
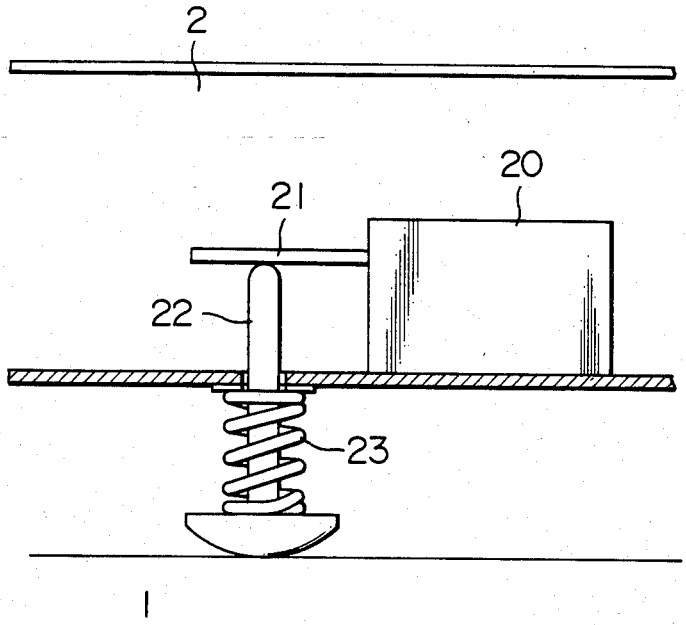
FIGS. 6 and 7 are partially enlarged views of the part A in FIG. 5.
Figure 7:
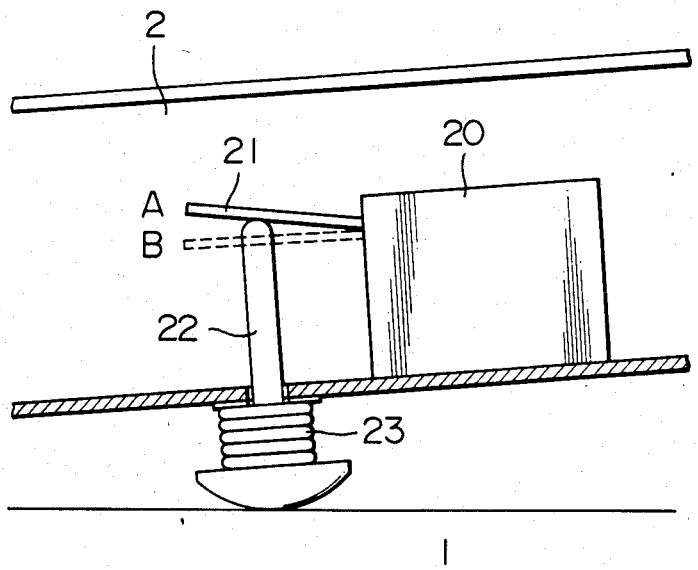

FIG. 5 is a partially cut-away sectional view of a sanitary cleaning apparatus comprising human body detector means according to an embodiment of the present invention. FIGS. 6 to 7 are enlarged partial views of the part A in FIG. 5. Numeral 20 designates a switch, numeral 21 a lever for imparting the vertical motion of a rod 22 to the switch 20, and numeral 23 a spring, these four parts making up the human body detector means. Numerals 24 and 25 designate pieces of foot rubber for absorbing the shock between the seat 2 and the stool 1 at the time of opening or closing the seat 2, which foot rubber are kept distant from the stool 1 when the human body 19 is not seated on the seat 2. Under this condition, the spring 23 is expanded as shown in FIG. 6. When the human body 19 is seated on the seat 2, the weight of the body 19 exerted on the seat 2 reduces the gap between the seat 2 and the stool 1 near the foot rubber piece 25 by the difference of thickness between the foot rubber pieces 24 and 25, with the result that as shown in FIG. 7, the spring 23 is contracted and the lever 21 is pressed by the rod 22 into the state as indicated by A thereby to turn on the switch 20. When the human body 19 leaves the seat 2, the lever 21 is urged into the state B as indicated by the dashed line in FIG. 7 to turn off the switch 20. The on-off opertion of the switch 20 makes up a human body detection signal.

Figure 8:
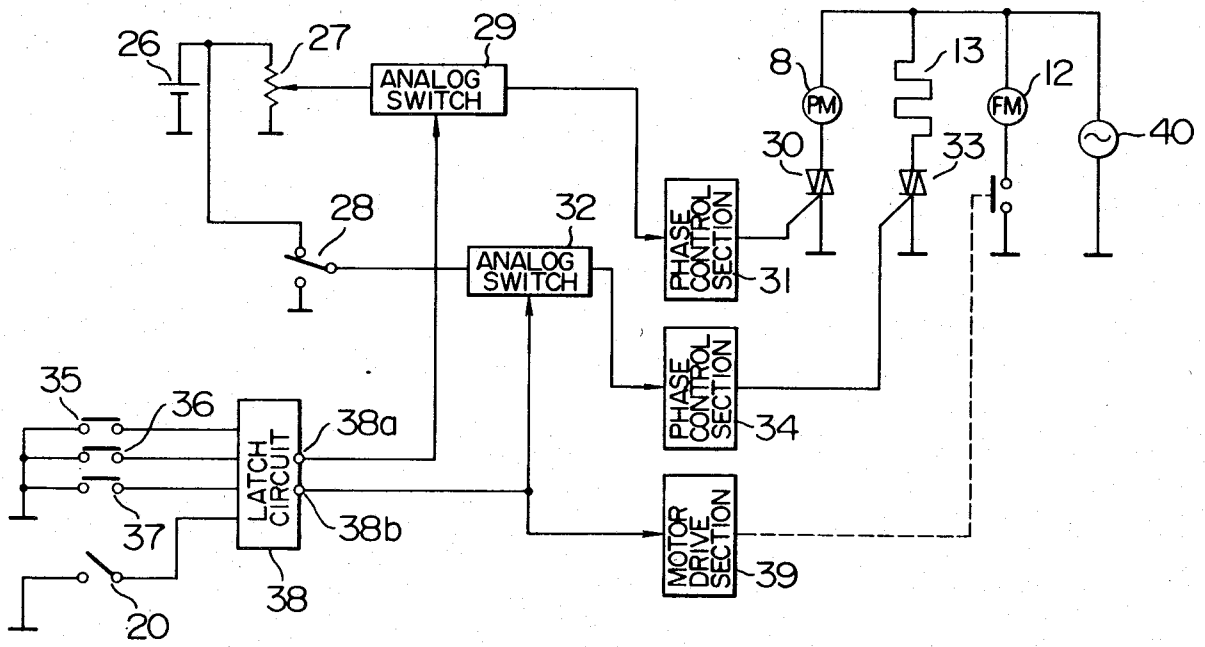
FIG. 8 is a control block diagram showing a sanitary cleaning apparatus according to an embodiment of the present invention.

FIG. 8 is a control block diagram, in which numeral 26 designates a DC power supply for supplying power to a water force regulator 27 for changing the water force by operating a cleaning adjusting knob 16 and a temperature setting switch 28 operated by the drying temperature knob 17. Numeral 29 designates an analog switch for transmitting on and off signals of the water force regulator 27 to the phase control section 31 of the bidirectional thyristor 30 for driving the cleaning pump 8 making up the cleaning water discharge means. Numeral 32 designates an analog switch for transmitting on and off signals of the temperature setting switch 28 to the phase control section 34 of the bidirectional thyristor 33 for driving the heater 13 making up the warm air drying means. Numeral 38 designates a latch circuit supplied with input signals from the on-off means 35 of the cleaning water discharge means, on-off means 36 and off switch 37 of the drying means, and the switch 20 mounted on the seat 2 of the human body detector means. Numeral **38*a* designates an output terminal for turning on the analog switch 29 by the operation of the on switch of the on-off means 35 of the cleaning water discharge means while the switch 20 of the human body detector means is on. Numeral 38*b* designates an output terminal connected to the motor drive section 39 for supplying power to the motor 12 for driving the blow fan 11 and turning on the analog switch 32 by the operation of the on switch of the on-off means 36 of the drying means while the switch 20 of the human body detector means is on. Numeral 40** designates a commercial power supply.

Figure 9:
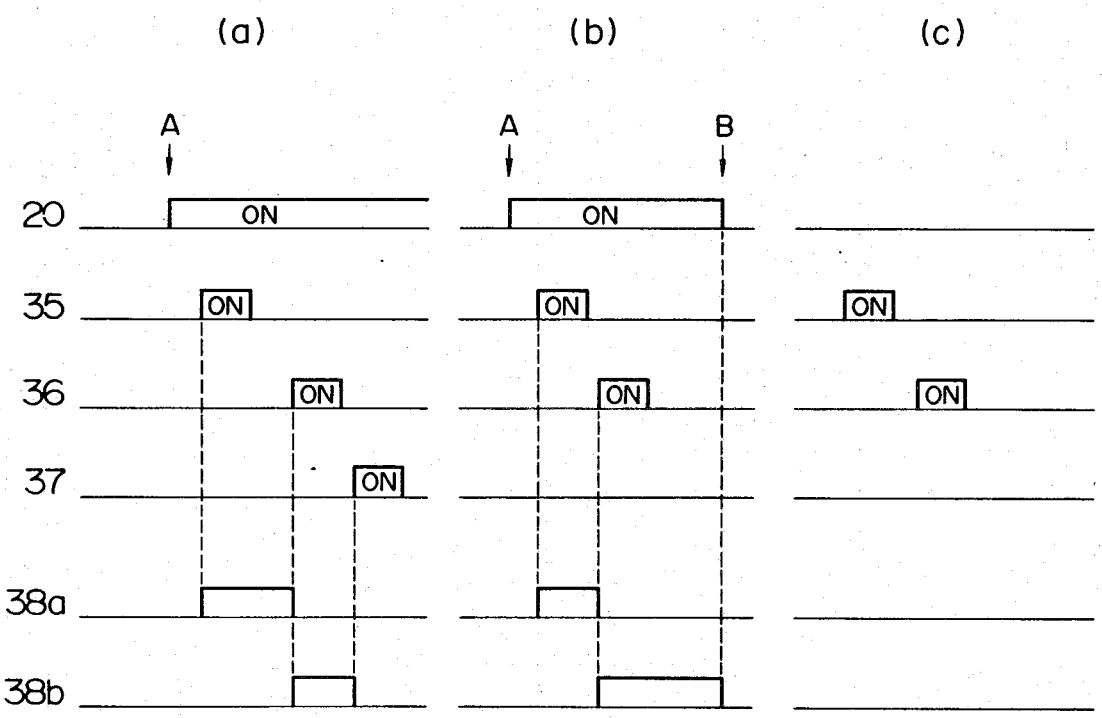
FIG. 9 is an operation sequence diagram for a latch circuit shown in FIG. 8.

FIGS. **9*a* to 9*c* are diagrams showing operation output waveforms produced from the latch circuit 38 when the on-off means 35 of the cleaning water discharge means, the on-off means 36 of the drying means, the off switch 37, and the switch 20 of the human body detector means are turned on and off respectively. In the case where the human body 19 is seated on the seat 2 and the switch 20 is turned on at points A as shown in FIG. 9*a*, the turning on of the on-off means of the cleaning water discharge means with the switch 20 on causes the output 38*a* of the latch circuit 38 to be produced to latch the circuit. When the on-off means 36 of the drying means is turned on at the next moment, the output 38*b* of the latch circuit 38 is latched while at the same time resetting the output 38*a* of the cleaning water discharge means. When the off switch 37 is turned on, all the outputs 38*a* and 38*b* of the latch circuit 38** are reset thereby to stop the cleaning water discharge means and the drying means.

When the switch 20 is turned as the human body 19 is seated on the seat 2 at point A as shown in FIG. **9*b*, on the other hand, turning on of the on-off means of the cleaning water discharge means with the switch 20 on causes the output 38*a* of the latch circuit 38** to be produced to latch the circuit.

When the on-off means 36 of the drying means is turned on at the next moment, the output **38*b* of the latch circuit 38 is latched while at the same time resetting the output 38*a* of the cleaning water discharge means. If the switch 20 is turned off at point B under this condition that is if the human body 19 leaves the seat 2, the outputs 38*a* and 38*b* of the latch circuit 38** are both reset thereby to stop the cleaning water discharge means and the drying means.

Assume that the on-off means 35 of the cleaning water discharge means or the on-off means 36 of the drying means is turned on while the human body 19 is not seated on the seat 2, that is, the switch 20 is off as shown by FIG. **9*c*, the outputs 38*a* and 38*b* of the latch circuit 38** remain reset, thereby keeping the cleaning water discharge means and the drying means off.

In the above-mentioned configuration, the turning on of the on-off means 35 of the cleaning water discharge means and the on-off means 36 of the drying means are effective only while the switch 20 of the human body detector means is on. Also, if the switch 20 of the human body detector means is turned off while the cleaning water discharge means or the drying means is in operation, the cleaning water discharge means or the drying means, as the case may be, is automatically stopped without turning on the off-switch 37.

Instead of the drying means complimenting the cleaning water discharge means used in the aforementioned embodiment, a bidet cleaning water discharge means may be used as a functional means with cleaning water discharge means for discharging the cleaning water to the anus, or drying means making up a functional means with a cleaning water discharge means including a bidet.

It will be understood from the foregoing description that the sanitary cleaning apparatus according to the present invention has the advantages described below.

Assume that the drying means is used as the functional means. When user is desirous of cleaning or drying the object parts, the cleaning or drying is possible only when the human body detector means detects the presence of a human body and the on-off means is turned on. If the absence of a human body is detected during the cleaning or drying of the object parts, on the other hand, the cleaning water discharge means or the drying means is automatically turned off. Specifically,it is possible to turn on the cleaning water discharge means and the drying means only when it is desired to use the apparatus really, thereby preventing a false operation, such as during the washing of the stool or the clothes of a child or the interior of the toilet from being wetted by his or her mischief or the continuous operation of a motor or like which might shorten the service life of the sanitary cleaning apparatus.

Further, when one of the cleaning water discharge means and the drying means is turned on, the remaining means is also turned off, or upon detection of the absence of a human body by the human body detector means, the means first turned on is automatically turned off, thereby offering an operating ease.

We claim:

1. A sanitary cleaning apparatus comprising a first functional means which discharges cleaning water to object parts, a second functional means which has a function identical to or different from the first functional means, and latch circuit means including first switching means switchable between a first state for turning on the first functional means and a second state for turning off the first functional means, second switching means switchable between a first state for turning on the second functional means and a second state for turning off the second functional means, and human body detector means for detecting the presence or absence of a human body, wherein the latch circuit means permits operation of a selected one of said first and second functional means only when the switching means for the selected functional means is placed in the first state in combination with detection of the presence of a human body by the human body detector means, and wherein the latch circuit prohibits operation of the selected functional means when said switching means for the other of said functional means is placed in the first state, said switching means for said selected functional means is placed in the second state, or the human body detector means setects the absence of a human body, the latch circuit means prohibiting the operation of the selected first or second functional means by placing the switching means for the selected functional means in the second state.

2. A sanitary cleaning apparatus according to claim 1, wherein the sanitary cleaning apparatus further comprises a stool, which stool has a seat positioned thereon, and wherein said human body detector means is operated when a human body is seated on the seat of the stool.

3. A sanitary cleaning apparatus according to claim 1, wherein one or both of said on-off means includes a key switch.

4. A sanitary cleaning apparatus according to claim 1, wherein said first functional means which discharges cleaning water discharges cleaning water to the anus and said second functional means includes a cleaning water discharge means having a bidet.

5. A sanitary cleaning apparatus comprising means for discharging cleaning water to object parts, means for drying the object parts cleaned by the cleaning water discharge means, and latch circuit means including first switching means switchable between a first state for turning on the cleaning water discharge means and a second state for turning off the cleaning water discharge means, second switching means switchable between a first state for turning on the drying means and a second state for turning off the drying means, and human body detector means for detecting the presence or absence of a human body, wherein the latch circuit means permits operation of a selected one of the cleaning water means and the drying means only when the switching means for the selected functional means is placed in the first state in combination with detection of the presence of a human body by the human body detector means, and wherein the latch circuit means prohibits operation of the selected one of the cleaning water discharge means and the drying means when said switching means for the other of said functional means is placed in the first state, said switching means for said selected functional means is placed in the second state, or the human body detector means detects the absence of a human body, the latch circuit means prohibiting the operation of the selected one of the cleaning water means and the drying means by placing the switching means for the selected functional means in the second state.

6. A santiary cleaning apparatus according to claim 5, wherein the sanitary cleaning apparatus further comprises a stool, which stool has a seat positioned thereon, and wherein said human body detector means is actuated when a human body is seated on the seat of the stool.

7. A sanitary cleaning apparatus according to claim 5, wherein one or both of said on-off means includes a key switch.

8. A sanitary cleaning apparatus according to claim 5, wherein said cleaning water discharge means discharges cleaning water to the anus.

* * * * *